US005597262A

United States Patent [19]

Beavers et al.

[11] Patent Number: 5,597,262

[45] Date of Patent: Jan. 28, 1997

[54] RESILIENT TRAFFIC BOLLARD WITH ROTATABLE COLLAR

[75] Inventors: Dale W. Beavers, 200 Deer Creek, Powell, Ohio 43065; Jerry F. Fischer, West Chester, Ohio; Vince Dicola, Cincinnati, Ohio; John D. Boyer, Lebanon, Ohio

[73] Assignee: Dale W. Beavers, Powell, Ohio

[21] Appl. No.: 411,484

[22] Filed: Mar. 28, 1995

[51] Int. Cl.[6] ..... E01F 9/01

[52] U.S. Cl. ..... 404/6; 404/9; 404/10; 116/63 R; 116/63 P

[58] Field of Search ..... 404/6, 9, 10, 11, 404/13; 116/63 R, 63 P; 256/13.1, 1; 40/608, 612

[56] References Cited

U.S. PATENT DOCUMENTS

| | | | |
|---|---|---|---|
| 1,903,869 | 4/1933 | Meister et al. . | |
| 3,416,484 | 12/1968 | Chapman | 116/67 |
| 3,442,187 | 5/1969 | Hausegger | 94/1.5 |
| 3,602,109 | 8/1971 | Harrington | 94/1.5 |
| 3,664,583 | 5/1972 | Allen | 238/5 |
| 3,693,940 | 9/1972 | Kendall et al. | 256/1 |
| 3,838,661 | 10/1974 | Medley, Jr. | 116/63 P |
| 4,270,873 | 6/1981 | Laehy et al. | 404/10 |
| 4,373,464 | 2/1983 | Blau | 116/63 |
| 4,435,106 | 3/1984 | Förster et al. | 404/6 |
| 4,515,499 | 5/1985 | Furiate | 404/6 |
| 4,571,118 | 2/1986 | Schmanski | 404/10 |
| 4,573,109 | 2/1986 | Lack | 362/194 |
| 4,662,611 | 5/1987 | Ruane | 256/13.1 |
| 4,759,161 | 7/1988 | Kucyk, Jr. et al. | 52/99 |
| 4,923,327 | 5/1990 | Gorlov | 404/6 |
| 5,018,902 | 5/1991 | Miller et al. | 404/6 |
| 5,029,783 | 7/1991 | Alvarez | 248/146 |
| 5,053,868 | 10/1991 | Higgins et al. | 358/93 |
| 5,105,347 | 4/1992 | Ruud et al. | 362/268 |
| 5,265,556 | 11/1993 | Hall | 116/63 |
| 5,397,197 | 3/1995 | Beavers | 404/10 |

FOREIGN PATENT DOCUMENTS

| | | |
|---|---|---|
| 0156158 | 10/1985 | European Pat. Off. . |
| 0355344 | 2/1990 | European Pat. Off. . |
| 2534290 | 4/1984 | France . |
| 2622613 | 5/1989 | France . |
| 2093892 | 9/1982 | United Kingdom . |
| 2107446 | 4/1983 | United Kingdom . |

*Primary Examiner*—Henry A. Bennett
*Assistant Examiner*—Pamela A. O'Connor
*Attorney, Agent, or Firm*—Mueller and Smith, LPA

[57] ABSTRACT

A traffic bollard mountable to a path surface for providing a barrier to a vehicle moving on the path surface. The bollard includes a stanchion member extending along a longitudinal axis from an upper distal end to a lower proximal end biasedly attachable to the path surface in a normally upright position. The stanchion member is flexible along substantially the entire extent of its longitudinal axis to be resiliently deflectable from its normally upright position upon the bollard being contacted with a predetermined amount of force by the moving vehicle. At least one collar is rotatably mounted about the stanchion member along the longitudinal axis thereof. The collar extends intermediate the distal and proximal ends of the stanchion member and freely rotates about the longitudinal axis thereof upon being contacted by the moving vehicle.

18 Claims, 5 Drawing Sheets

RESILIENT TRAFFIC BOLLARD WITH ROTATABLE COLLAR

BACKGROUND OF THE INVENTION

The present invention relates generally to bollards, such as may be used to provide a barrier to traffic, and more particularly to a bollard which is not damaged when struck by a vehicle and which does not do damage to the vehicle when struck thereby.

Many types of roadway barriers have been proposed over the years, and many varieties presently are in use. Bollards or post can be placed between lanes of traffic for lane delineation or within parking lots to control traffic flow patterns. Bollards additionally are placed adjacent drive-through windows of restaurants or automatic bank teller machines (ATMs) to protect the building and to direct accessing vehicles to a proper position adjacent the window. For may applications, fixed bollards are not desired as causing damage to the vehicles when struck, which damage may give rise to significant liability claims to be borne by the property owner or the insurance carrier thereof. Indeed, depending on customer volume, many businesses are faced with an average of five damage claims per month. The cost of these claims to these businesses cannot be measured solely in pecuniary terms, but also includes the loss of the goodwill of the aggrieved customers, as well as the overall frustration of having to administrate the claims.

In this regard, collapsible bollards have been proposed in the art, although such bollards may be damaged when struck by a vehicle and, more typically, nevertheless do considerable damage to the vehicle. U.S. Pat. No. 3,602,109 shows a barrier assembly comprising a series of individual guard-roll barrier units which comprise a series of inverted frustroconical rollers which guide an errant automobile along a safe path. U.S. Pat. No. 5,105,347 shows that bollards can be illuminated. U.S. Pat. No. 4,515,499 shows that traffic lane bollards can be mounted on a spring for providing a return mechanism when struck by automobiles. U.S. Pat. No. 5,018,902 proposes a bollard which is collapsible with an ordinary fire hydrant wrench. U.S. Pat. No. 4,373,464 proposes a bollard which has a flexible column surrounded by a coil spring which has a cover thereover and is collapsible when struck by a vehicle. U.S. Pat. No. 3,442,187 shows a similar spring containing bollard which collapses when struck by a vehicle.

Despite the proposals for collapsible bollards, there nonetheless remains a significant need for a bollard design which is not damaged each time it is struck by a vehicle, and which concomitantly protects the vehicle against being damaged therefrom. The present invention is directed to such a bollard development.

BROAD STATEMENT OF THE INVENTION

The present invention is directed to a bollard made of an elongate member having a lower proximal end biasedly attachable in an upright position to a path surface, an upper distal end, and a longitudinal axis. At least one collar is attached to the elongate member about its upper distal end, which collar is rotatable about the longitudinal axis of the elongate member. When such bollard is mounted on or adjacent a path surface, the bollard is deflectable from its upright position about its proximal end, e.g., when contacted by a vehicle. Concomitantly with such deflection, the collar rotates when in contact with the vehicle for following the contour thereof without damaging the vehicle. Specific bollard configurations are disclosed herein along with numerous attachments with which the inventive bollard can be outfitted.

It is, therefore, an object of the present invention to provide a traffic bollard mountable to a path surface for providing a barrier to a vehicle moving on the path surface. The bollard includes a stanchion member extending along a longitudinal axis from an upper distal end to a lower proximal end biasedly attachable to the path surface in a normally upright position. The stanchion member is flexible along substantially the entire extent of its longitudinal axis to be resiliently deflectable from its normally upright position upon the bollard being contacted with a predetermined amount of force by the moving vehicle. At least one collar is rotatably mounted about the stanchion member along the longitudinal axis thereof. The collar extends intermediate the distal and proximal ends of the stanchion member and freely rotates about the longitudinal axis thereof upon being contacted by the moving vehicle.

It is another object of the present invention to provide a traffic bollard mountable to a path surface for providing a barrier to a vehicle moving on the path surface. The bollard includes a lower base member of a first diametric extent having an upper distal end and a lower proximal end attachable to the path surface. An upper stanchion member is coaxially-aligned with the lower base member, which member has a second diametric extent within the first diametric extent of the base member. The stanchion member extends along a longitudinal axis from an upper distal end to a lower proximal end biasedly attached to the upper distal end of the base member orienting the stanchion member in a normally upright position, and is resiliently deflectable therefrom upon the bollard being contacted with a predetermined amount of force by the moving vehicle. At least one collar is rotatably mounted about the stanchion member along the longitudinal axis thereof. The collar extends intermediate the distal and proximal ends of the stanchion member and rotates freely about the longitudinal axis thereof upon being contacted by the moving vehicle.

Advantages of the present invention include a bollard which can be deflected from its upright position when contacted by a vehicle without damaging the bollard and while concomitantly minimizing any damage to the vehicle. Another advantage is a bollard that is easy to manufacture and install. Another advantage is a bollard design that can be used in a wide variety of situations from controlling foot traffic to bicycle traffic to vehicle traffic. These and other advantages will be readily apparent to those skilled in the art based upon the disclosure contained herein.

The invention, accordingly, comprises the apparatus possessing the construction, combination of elements, and arrangement of parts which are exemplified in the following detailed description. Reference to that description and to the accompanying drawings should be had for a fuller understanding and appreciation of the nature and objects of the invention, although other objects may be obvious to those skilled in the art.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

The present invention is directed to a bollard made of an elongate member having a lower proximal end biasedly attachable in an upright position to a path surface, an upper distal end, and a longitudinal axis. A collar is attached to the elongate member about its upper distal end. The collar is rotatable about the longitudinal axis of the elongate member. When such bollard is mounted on or adjacent a path surface, the bollard is deflectable from its upright position about its proximal end, e.g., when contacted by a vehicle. The collar rotates when in contact with the vehicle for following the contour of the vehicle without damaging the vehicle. Specific bollard configurations are disclosed herein along with numerous attachments with which the inventive bollard can be outfitted.

For illustrative purposes, the bollard of the present invention is described in the discourse to follow in conjunction with its employment adjacent an automatic teller machine (ATM). However, it will be appreciated that the present invention exhibits features which makes its suitable for use in other applications, such as in the marking of other drive-through installations as may be found in restaurants and banks, or in the delineation of traffic lanes or parking lot accesses. Indeed, the inventive bollard is suited for most any application where barriers to vehicular traffic are required, or where motorists must be alerted of an obstacle to be avoided. Accordingly, such bollard is expected to find utility in both roadways and parking lots and the like, as well as in a variety of settings such as shopping centers and malls, hospitals, schools and universities, amusement parks, government and military installations, office parks, and industrial facilities.

Figure 1:
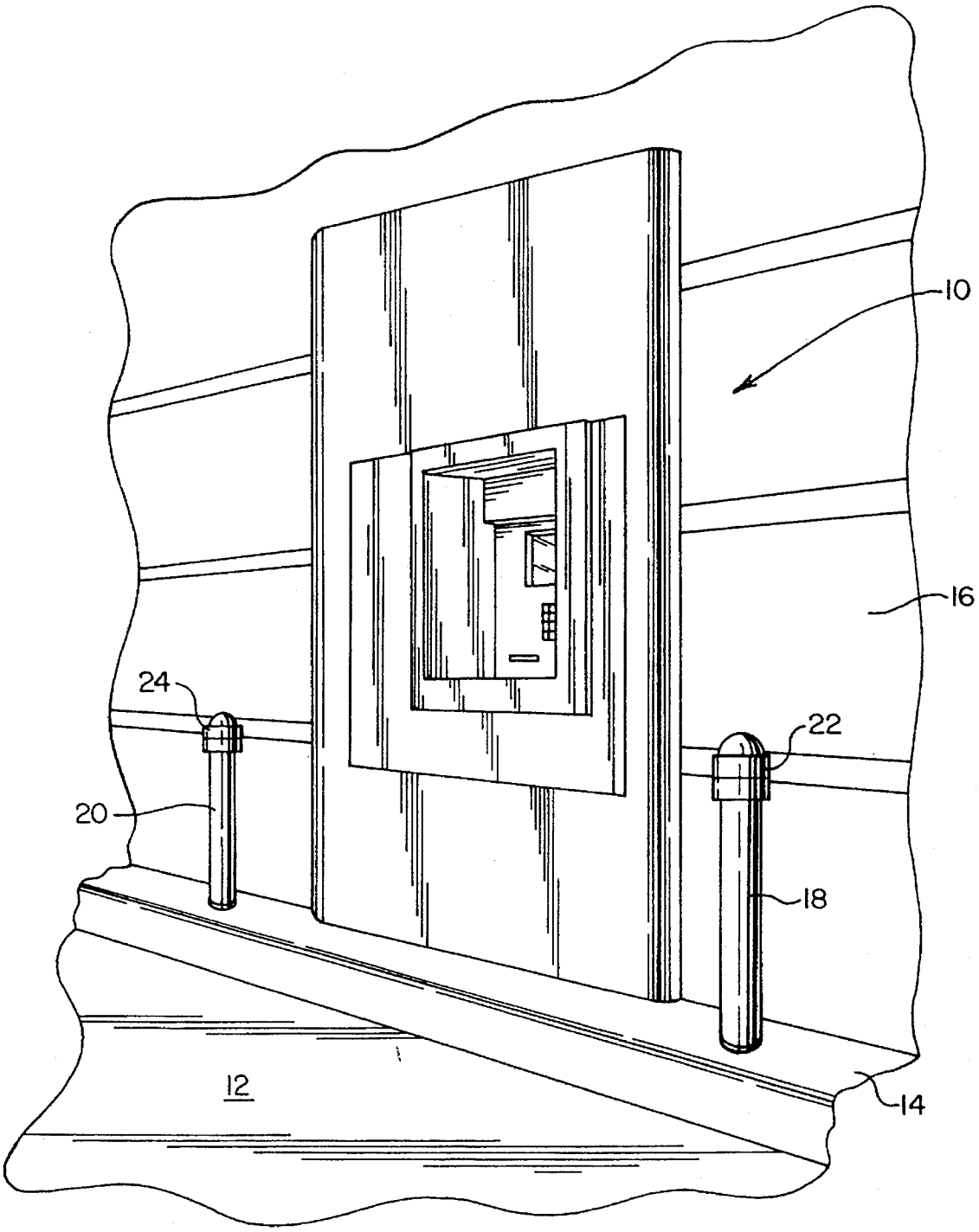
FIG. 1 is a perspective view of a bank automatic teller machine (ATM) having a pair of the bollards according to the present invention established in a curb adjacent the machine for preventing accessing vehicles from accidentally striking the machine.

Looking then to FIG. 1, and as is disclosed by Beavers, U.S. Pat. No. 5,397,197, the disclosure of which is expressly incorporated herein by reference, the bollard of the present invention is shown in connection with its disposition adjacent an ATM, 10, as a means for providing a barrier to accessing vehicles. It will be observed that vehicles approach ATM 10 via drive 12, wherein curb 14 is intended to keep such vehicles from striking structure 16 which houses ATM 10. In order for the passenger to reach the control panel of ATM 10, however, it is located sufficiently near roadway 12 such that it is possible for a vehicle to strike it unintentionally. Bollards 18 and 20 therefore are intended to prevent the approaching vehicle from striking ATM 10. Such bollards, if made of rigid metal or the like, would damage the vehicle and likely give rise to a liability claim against the property owner. Even bollards that are flexible, however, nonetheless may damage the vehicle. Inventive bollards 18 and 20 therefore are provided with a pair of collars, 22 and 24, respectively, which collars roll along the contact area of the vehicle for preventing or at least minimizing any damage to the vehicle. The bollards are resilient in being deflectable from an upright position when sufficient force is applied by a contacting vehicle, but able to return to the upright position thereafter.

Figure 2:
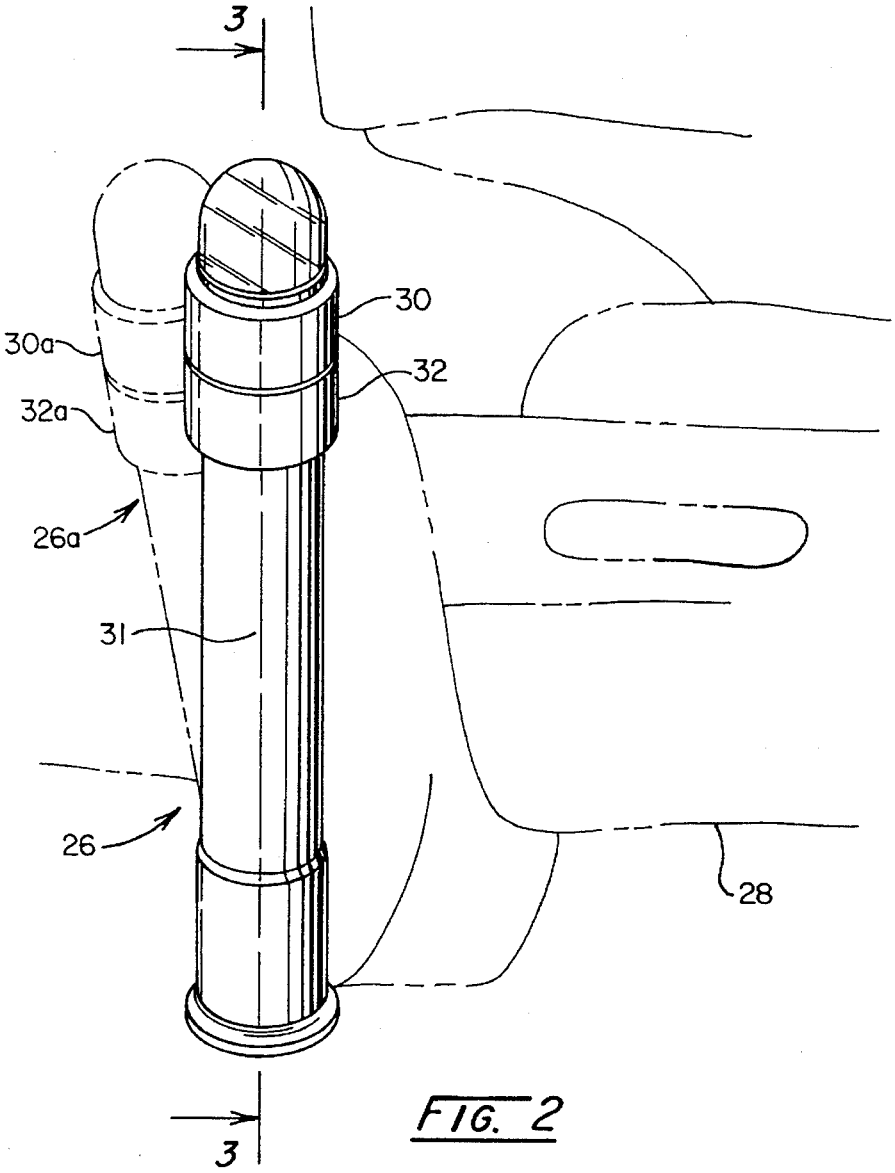
FIG. 2 is a perspective view of the bollard of the present invention in its fixed upright position shown as being struck by an automobile and, in phantom, as being deflected from its upright position in response thereto.

Such deflection can be seen by referring to FIG. 2 wherein bollard 26 is depicted as being struck by automobile, shown in phantom at 28, resulting in bollard 26 being deflected to the phantomed position identified at 26*a*. A pair of collars, 30 and 32, correspondingly represented at 30*a* and 32*a* for deflected bollard 26*a* shown in phantom, rotate about the longitudinal axis, 31, of bollard 26 for minimizing any damage to vehicle 28. When vehicle 28 moves out of contact with bollard 26*a*, bollard 26*a* returns to its normal upright position.

Figure 3:
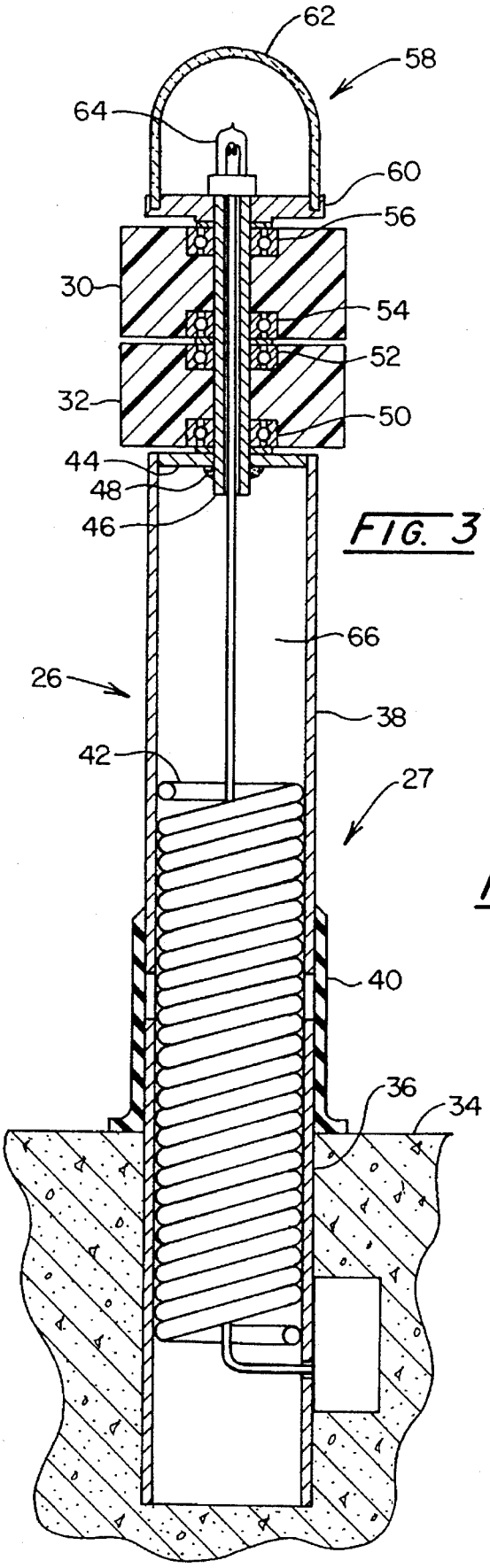
FIG. 3 is a cross-sectional view of the bollard of FIG. 2 taken through line 3—3 of FIG. 2.

Referring next to FIG. 3, which figure is a sectional view of bollard 26 taken along line 3—3 of FIG. 2, it will be observed that bollard 26 is securely attached to concrete 34 at its lower proximal end with a biasing assembly, shown generally at 27. It should be appreciated, however, that bollard 26 alternatively may be embedded in pavement, earth, or layers of such materials. Into concrete 34 is placed rigid lower elongate hollow tube 36 which can be manufactured of, for example, a polymeric material or a metal optionally selected or treated to be resistant to corrosion. Upper elongate hollow tube 38 is spaced apart from tube 36 with rubber grommet 40 sealing such gap therebetween and sealing tube 36 to concrete 34, e.g., to prevent infiltration of moisture, dirt, or like foreign matter.

Coil spring 42 is disposed within both tubes 36 and 38 under compression for providing connection therebetween. The spring constant is selected such that a predetermined minimum force is required for deflecting bollard 26 from the upright position to its deflected position as depicted at FIG. 2.

Through upper distal end of tube 38 is formed a hole penetrating in end plate 44 through which elongate member 46 is inserted and welded at its lower proximal end, as at weld 48. Mounted about elongate member 46 are collars 30 and 32, which collars rotate about longitudinal axis 31 (FIG. 2) of bollard 26. Ball bearing assemblies 50, 52, 54, 56 permit collars 30 and 32 to freely rotate when contacted by an automobile or other vehicle. As such collars rotate, bollard 26 is made to follow the outer surface configuration of the striking vehicle. Such rotation also controls the angle of deflection of bollard 26 and minimizes damage to the vehicle in contact therewith.

Figure 4:
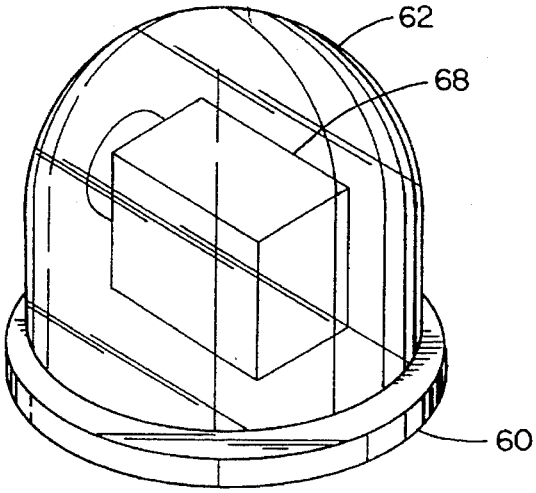
FIG. 4 is a perspective view of the upper cap or dome of the bollard of FIG. 3 showing a TV camera mounted therein.

Mounted atop bollard 26 is illumination fixture 58 composed of plate 60, which is screwed onto the threads formed in the upper distal end of elongate member 46, dome 62, which is constructed of light transmissive, optionally colored or tinted, plastic material, and light bulb or LED 64, which is connected to a source of electrical power via line 66. It will be appreciated that fixture 58 alternatively may be provided as a colored, light reflecting material, or even as a video camera as shown in FIG. 4 at 68. Indeed, there is virtually no limit to the function and accessories which can be adapted to fixture 58 depending upon the location and use intended for bollard 26.

In addition to the coil spring depicted in FIG. 3, a variety of mechanisms for flexibly mounting the bollard to the ground may be envisioned. For example, an alternative biasing assembly arrangement is shown generally at 71 in FIG. 5 for bollard 70. For bollard 70, elongate annular sleeve 72 similarly is embedded in concrete or other ground material 34 with upper elongate member 74 provided in a spaced-apart relationship therefrom. Flexible protective sleeve 76, constructed of an elastomeric or polymeric material, covers tube 74 and extends down to the ground level of concrete 34. Sleeve 76, apart from providing protection to the bollard, may add a high-visibility color thereto for providing an enhanced visual warning, or may be printed with advertising literature, traffic directions, or the like. Mounted atop tube 74, i.e., the upper distal end of bollard 70, in upper plate 78 is elongate member 80 which also is welded in position at its lower proximal end, as at weld 82. The upper distal end of elongate member 80 is threaded for receiving cap or dome 84, which may be, for example, formed of a brightly colored or light reflecting, plastic, metal, ceramic, or other material. Collars 86, 88, 90 are retained about elongate member 80 and similarly rotate upon ball bearing assemblies 92, 94, 96, 98, 100, 102. One or more collars may surmount the bollard and may extend substantially to the ground if necessary, desirable, or convenient.

Figure 5:
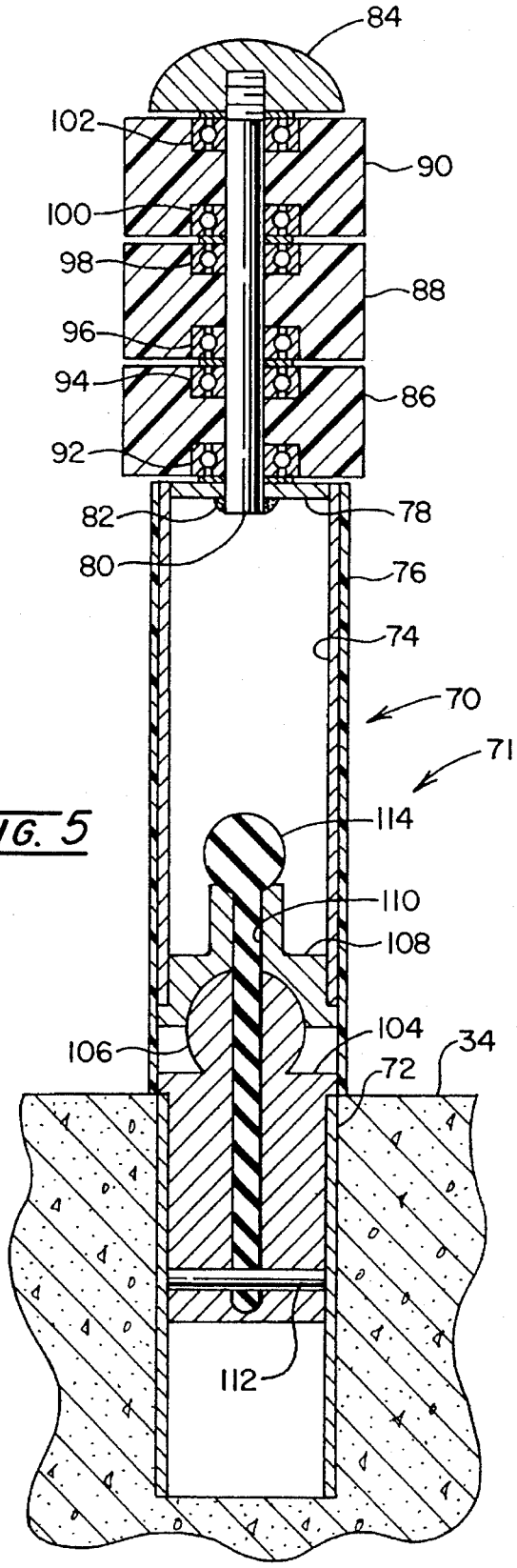
FIG. 5 is a cross-sectional view of a bollard according to the present invention having an alternative bias mounting assembly, a different number of rollers about its upper distal end, and a different upper cap or dome arrangement.

For effecting the deflection of the bollard from its upright position and its return subsequent to being struck by a vehicle, disposed in tube 72 is resilient member 104 which bears upper ball 106 at its upper distal end. Extending into lower proximal end of tube 74 is flexible member 108 which has a lower hemispherical recess adapted to tightly fit and conform to ball 106. Such ball and joint assembly of members 104 and 108 secure lower tube 72 to upper tube 74 and permit upper tube 74 to be deflected from an upright position when bollard 70 is struck, for example, by a vehicle. Resiliency is provided by flexible member 110 which extends through member 108 and 104, and is secured by pin 110 to lower proximal end member 104 and tube 72. Upper ball 114 at the upper distal end of pin 110 secures flexible rod 110 at its upper distal end as shown at FIG. 5. By suitably adjusting the flexibility or resiliency of members 104, 108, and 110, the force required to deflect bollard 70 from an upright can be determined and designed.

It will be appreciated that a variety of additional means effecting the deflection of the bollard from its upright position and its return after being contacted by a vehicle may be envisioned by those skilled in the art based upon the disclosure contained herein. For that matter, the upper and lower tubes shown for bollards 26 and 70 need not be constructed of metal, but alternatively may be formed of a polymeric or even a ceramic material depending upon design considerations. Inasmuch as the bollard may be used as a safety device to protect property, as is depicted at FIG. 1, to delineate traffic, and for a variety of other uses, the materials of construction may change as would the degree of force required to deflect the bollards. Such uses also will dictate the cap or dome assembly that will surmount the bollard. While concrete 34 has been shown as the path surface in which the bollard is mounted, it will be appreciated that the bollard of the present invention may be mounted to any suitable path surface.

Figure 6:
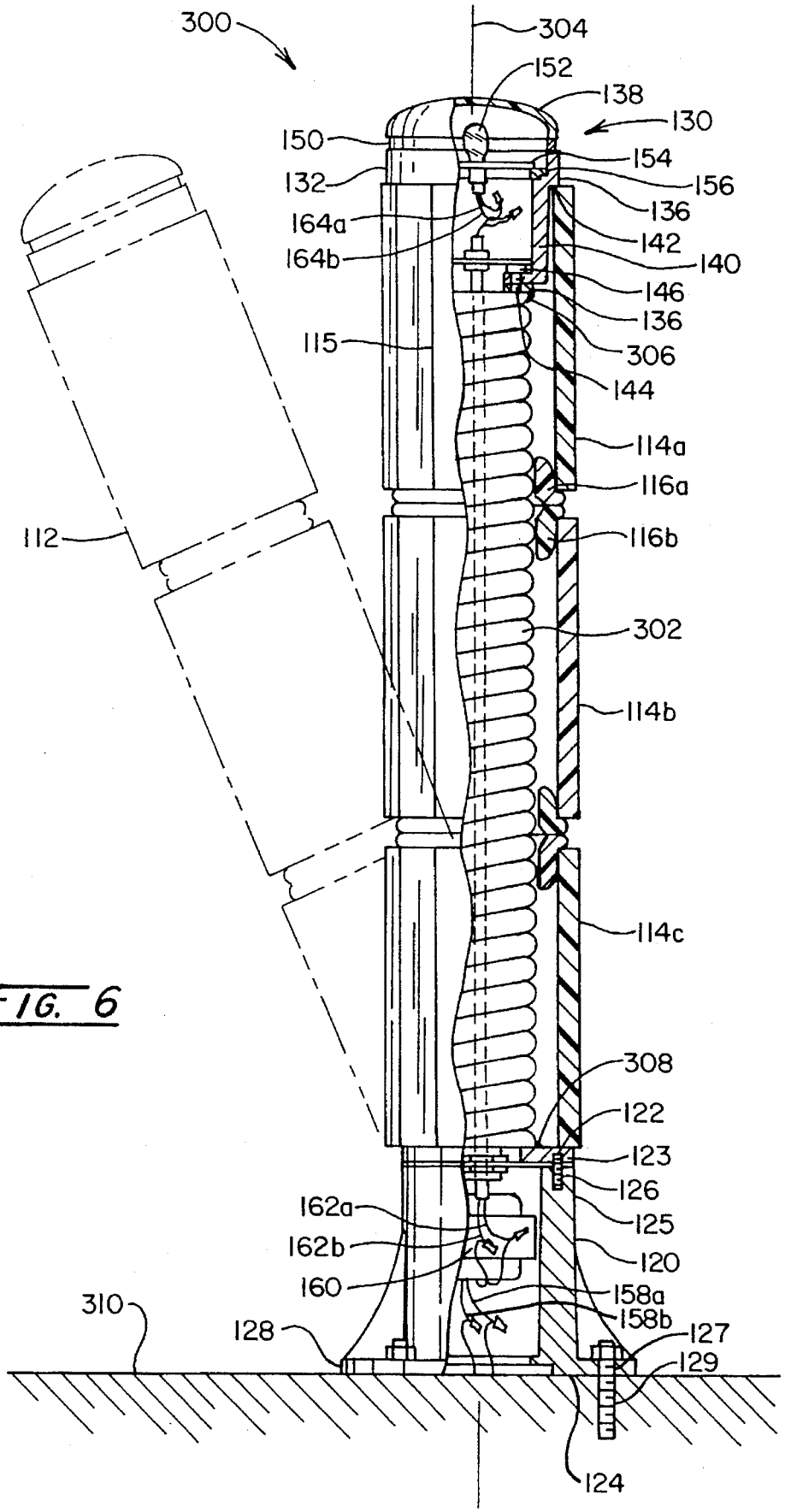
FIG. 6 is a partially cross-sectional view of an alternative embodiment of a bollard according to the present invention having a flexible stanchion member which, as is shown in phantom, is resiliently deflectable from a normally upright position.

Referring next to FIG. 6 wherein certain improvements in the bollard structure disclosed in U.S. Pat. No. 5,397,197 are depicted, an alternative embodiment of the bollard of the present invention is shown generally at 300 as having a flexible stanchion member, 302, extending therethrough. Stanchion 302 extends along a longitudinal axis, 304, from an upper distal end, 306, to a lower proximal end, 308. By virtue of its provision as being flexible substantially along the entire extent of its longitudinal axis 304, stanchion 302 is made to be biasedly attachable to a path surface, represented at 310, without the provision and attendant cost of a separate biasing assembly. Additionally, such flexibility provides stanchion 302 with the resiliency to return to its normally-biased, upright position after, as is shown in phantom at 112, being deflected therefrom upon being contacted with a predetermined amount of force by a moving vehicle or the like.

As to the provision of stanchion 302 as a flexible member, it is preferred, as shown, that stanchion 302 be formed as a generally helically-coiled, tension spring extending between distal and proximal ends 306 and 308 along substantially the entire extent of longitudinal axis 304. In this regard, such spring may be constructed of 9/16-inch thick steel wire which is wound into a 3-inch diameter coil. Such a configuration has been observed to achieve a spring constant effective for the biased attachment of stanchion 302 to path surface 310 in a normally upright position, and for the resilient deflection of stanchion 302 therefrom upon being contacted with a predetermined amount of force by a moving vehicle or the like. Alternatively, however, stanchion 302 may be formed of a polymeric material selected as having elastomeric properties, such as a durometer hardness of from about 40 Shore A to about 75 Shore D, or a flexural modulus of from about 1000 to 300,000 psi, effective for achieving a resiliency within the precepts of the present invention.

For following the outer surface configuration of the contacting vehicle, bollard 300 additionally is provided with at least one and, preferably, two or more collars or bumpers, three of which are shown respectively at 114*a–c*. Collars 114 may be formed of an energy-absorbing, elastomeric material such as a cross-linked, ethylene-propylene copolymer (EPDM) or the like. As is shown, collars 114 may be formed, generally for aesthetic reasons, as having a number of outwardly-extending facets, one of which is shown at 115. Alternatively, collars 114 may be formed has having a generally smooth outer surface.

Each of collars 114 are independently rotatably mounted about longitudinal axis 304 of stanchion 302, with each extending intermediate the distal and proximal ends 306 and 308 thereof. For the freely rotatable mounting of collars 112 about stanchion 302, each is provided to bear upon at least one bushing, a pair of which are shown at 116*a* and 116*b*. Preferably, each of bushings 116 are formed of a nylon material or the like having a relatively low coefficient of friction to facilitate the rotatable beating of collars 114 thereon.

Advantageously, with stanchion member provided as being flexible along substantially the entire extent of longitudinal axis 304, bollard 300 may be made to be articulable intermediate each adjacent pair of collars 114, for example, as between collars 114*a* and 114*b*. In this way, at least a portion of the impact force or energy transferred to the contacted roller may be relieved through the articulation of flexible stanchion 302. Moreover, with the described articulation of stanchion, bollard 300 may better accommodate and follow the impact curve profile of the contacting vehicle which may have a discontinuous or otherwise irregular outer surface configuration. Further in this regard, it is preferred that a plurality of collars 114 are provided to extend along substantially the entire lengthwise extent of longitudinal axis 304 of stanchion 302. With a plurality of independently rotatable collars 114 so provided, bollard 300 is able to accommodate contact at any height level thereof such as may be caused by a lower-profile sports car or the like, or a higher-profile sports utility vehicle, truck, or the like.

Continuing with FIG. 6, stanchion 302 is shown to be optionally supported on a lower standard or base member, 120, having an upper distal end, 122, formed as an upper plate, 123, to which the lower proximal end 308 of stanchion 302 is biasedly attached as with a weld or other means, and having a lower proximal end, 124, configured for attachment to path surface 310. As is shown, plate 123 may be removably attached to a sidewall portion, 125, of base member 120 with a number of mechanical fasteners, one of which is shown at 126. With the arrangement of collars 114 illustrated in FIG. 6, upper distal end 122 of base member 120 forms a bearing surface upon which the lowermost collar 114, i.e., 114*c*, is rotatably received. In turn, for its attachment to path surface 310, proximal end 124 of base member 120 may be provided as having a number of holes, one of which is represented at 127, formed though a tanged portion, 128, thereof. Each of holes 127 preferably are configured to receive a 12-inch long steel bolt, 129, for the secure anchoring of bollard 300 into a concrete path surface 310. With stanchion 302 supported on base member 120, bollard 300 may be provided as having an overall height of from about 34 to 42 inches, with a height of 34 or 42 inches being preferred for drive-through applications. Preferably, base member 120 is formed of a cast aluminum covered with a powder coating composition.

It will be appreciated from FIG. 6 that upper stanchion member 302 is formed as having a diametric extent within the diametric extent of lower base member 120. That is, base member 120 is formed as having a diametric extent greater than or extending beyond the diametric extent of stanchion member 302. Such an arrangement allows base member 120 to be sized to provide a stable pedestal supporting the biased attachment of stanchion member 302 to path surface 310. Moreover, in such an arrangement stanchion member 302 is provided for the rotation of the collars 114 thereon as an axle separate and distinct from base member 120. Such provision facilitates the utilization of collars of a given diametric extent having wall thicknesses and, accordingly, strengths, which are increased over collars of equal diametric extent which otherwise would have to be configured to rotate about base member 120. Additionally, the mounting of collars 114 on a separate axle, i.e., stanchion member 302, having a smaller diameter than base member 120 facilitates the utilization of smaller bearings and races or bushings, as shown at 116, which otherwise would have to be sized to accommodate the relatively larger diameter of base member 120.

To enhance its visibility, bollard 300 may including a surmounting luminary assembly, shown generally at 130, mounted atop the upper distal end 306 of stanchion member 302 for illuminating at least a portion of bollard 100. Luminary assembly 130 may be seen to include a housing, 132, connected to the upper distal end 306 of stanchion member 302 via a base plate, 134, thereof, and formed as having a generally cylindrical sidewall portion, 136, extending upwardly from stanchion 302 distal end 306 to a terminal domed portion, 138. Preferably, housing 132 additionally is formed as having a lower beating portion, 140, received within the uppermost collar 114, i.e., collar 114*a*, and forming a shoulder portion, 142, with sidewall portion 136 receiving a corresponding beating surface of collar 114*a*. Lower bearing portion 140 of housing 132 terminates at a generally planar end portion, 144, which may be removably attached to base plate 134 of stanchion member 302 via a number of mechanical fasteners, one of which is shown at 146. As was base member 120, it is preferred that housing 132 be formed of a cast aluminum material which is covered with a powder coating composition.

Within sidewall portion 136 of housing 132, a lens 150, is formed as a band of a light-transmitting material such as a translucent or transparent acrylic. Depending upon the intended application for bollard 300, lens 150 may tinted to transmit light in the green, yellow, or red bands of the visible spectrum providing to the passing motorist what will be understood to be a corresponding visual "go," "caution," or "stop" indicia. For illuminating lens 150, a lamp 152, is disposed within dome and sidewall portions 138 and 136 of housing 132. Lamp 152, which may be provided as a low wattage bulb, an LED, or the like, is supported via a bracket, 154, or like support which may be removable attached with a fastener, 156, to shoulder portion 142 of housing 132. Lamp 152 is energized via lines 158*a* and 158*b* supplying electrical power at, preferably, a line voltage of 120 V which may be stepped-down via a transformer, 160, housed within base member 120. From transformer 160, power lines 162*a* and 162*b* extend through stanchion member 302 generally along longitudinal axis 304 thereof, and ultimately terminate at lines 164*a* and 164*b* leading to lamp 152. As an alternative to the arrangement described, luminary assembly 130 may be provided as having a band of reflective material substituted for lens 150, such band reflecting incident light from vehicle headlights or the like for effecting the illumination of at least a portion of bollard 300.

Figure 7A:
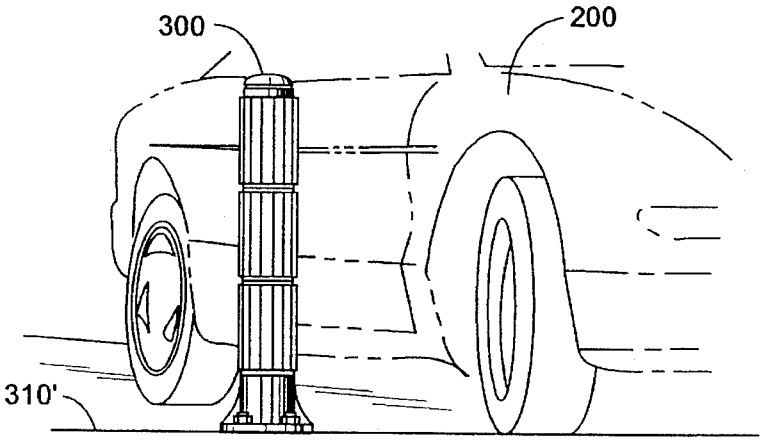
FIG. 7A is a perspective view of the bollard of FIG. 6 shown mounted to a path surface upon which a vehicle is moving in approach of the bollard.
Figure 7B:
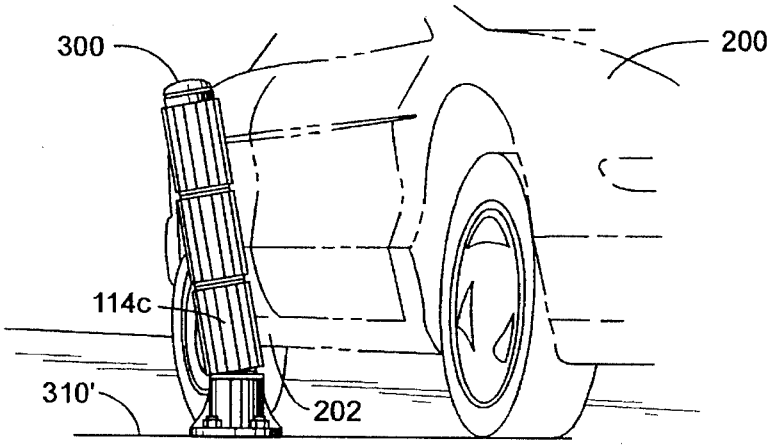
FIG. 7B is a perspective of view of the bollard FIG. 7A shown as being deflected from its normally upright position upon being contacted with a predetermined amount of force by the moving vehicle.
Figure 7C:
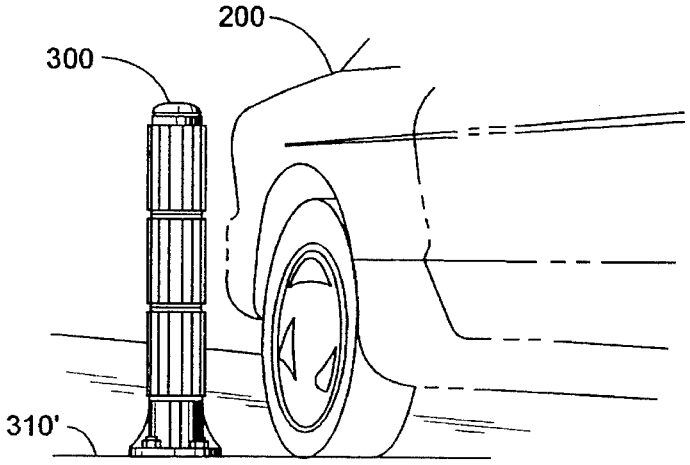
FIG. 7C is a perspective view of the bollard of FIG. 7B shown as having resiliently returned to its normally upright position thereafter its being contacted by the moving vehicle.

Looking next to the sequence of figures shown at FIGS. 7A–C, the precepts of bollard 300 of the present invention are illustrated in connection with its being mounted to path surface 310' upon which, as is shown in FIG. 7B, a vehicle, 200, is traveling in close adjacency thereto. As is shown in FIG. 7B, as a rocker panel portion 202 of vehicle 200 strikes or otherwise contacts a collar 114 such as collar 114*c* of bollard 300, stanchion member 302 (hidden from view) is deflected from its upright position. Concomitantly therewith, collar 114*c* freely rotates along the impact curve profile or surface contour of vehicle 200, further minimizing any damaging thereto. As is shown in FIG. 7C, bollard 300 resiliently returns to its normally upright position thereafter its being contacted by vehicle 200. From figure sequence 7A–C, it will be appreciated the bollard 300 of the present invention advantageously flexes and rolls with the vehicle notwithstanding, within design parameters, the angle or level of contact thereof.

As it is anticipated that certain changes may be made in the present invention without departing from the precepts herein involved, it is intended that all matter contained in the foregoing description or shown in the accompanying drawings shall be interpreted as illustrative and not in a limiting sense.

What is claimed:

1. A traffic bollard mountable to a path surface for providing a barrier to a vehicle moving on the path surface, said bollard comprising:

a lower base member of a first diametric extent having an upper distal end and a lower proximal end attachable to the path surface;

an upper stanchion member coaxially-aligned with said lower base member having a second diametric extent within the first diametric extent of said base member, said stanchion member extending along a longitudinal axis from an upper distal end to a lower proximal end biasedly attached to the upper distal end of said base member orienting said stanchion member in a normally upright position, and being resiliently deflectable therefrom upon said bollard being contacted with a predetermined amount of force by the moving vehicle; and at least one collar rotatably mounted about said stanchion member along the longitudinal axis thereof, said collar extending intermediate the distal and proximal ends of said stanchion member and rotating freely about the longitudinal axis thereof upon being contacted by the moving vehicle.

2. The bollard of claim 1 wherein said stanchion member is flexible along substantially the entire extent of its longitudinal for its biased attachment to said base member in a normally upright position and its resilient deflectable therefrom.

3. The bollard of claim 2 comprising at least a first and a second said collar independently freely rotatably mounted about said stanchion member along the longitudinal axis thereof, said stanchion member being articulable intermediate said first and said second collar.

4. The bollard of claim 1 wherein said stanchion member comprises a generally helically-coiled, tension spring member, said spring member being flexible along substantially the entire extent of its longitudinal axis for its biased attachment to said base member in a normally upright position and its resilient deflection therefrom.

5. The bollard of claim 4 comprising at least a first and a second said collar independently freely rotatably mounted about said spring member along the longitudinal axis thereof, said spring member being articulable intermediate said first and said second collar.

6. The bollard of claim 1 comprising a plurality of said collars independently freely rotatably mounted about said stanchion member to extend along substantially the entire extent of the longitudinal axis thereof.

7. The bollard of claim 1 further comprising a luminary assembly mounted atop the upper distal end of said elongate member for illuminating at least a portion of said bollard.

8. The bollard of claim 7 wherein said luminary assembly comprises:

a housing connected to the upper distal end of said stanchion member, said housing formed has having a generally cylindrical sidewall portion extending upwardly from the distal end of said stanchion member to a terminal domed portion;

a lens integrally formed as a light-transmitting band within the sidewall portion of said housing; and a lamp disposed within said housing, said lamp being electrically energizable to illuminate said lens.

9. The bollard of claim 7 wherein said luminary assembly comprises:

a housing connected to the upper distal end of said stanchion member, said housing formed has having a generally cylindrical sidewall portion extending upwardly from the distal end of said stanchion member to a terminal domed portion;

a reflector integrally formed as a band within the sidewall portion of said housing, said reflector reflecting incident light for its illumination.

10. A traffic bollard mountable to a path surface for providing a barrier to a vehicle moving on the path surface, said bollard comprising:

a stanchion member extending along a longitudinal axis from an upper distal end to a lower proximal end biasedly attachable to the path surface in a normally upright position, said stanchion member being flexible along substantially the entire extent of its longitudinal axis to be resiliently deflectable from its normally upright position upon said bollard being contacted with a predetermined amount of force by the moving vehicle; and at least one collar rotatably mounted about said stanchion member along the longitudinal axis thereof, said collar extending intermediate the distal and proximal ends of said stanchion member and rotating freely about the longitudinal axis thereof upon being contacted by the moving vehicle.

11. The bollard of claim 10 comprising at least a first and a second said collar independently freely rotatably mounted about said stanchion member along the longitudinal axis thereof, said stanchion member being articulable intermediate said first and said second collar.

12. The bollard of claim 10 comprising a plurality of said collars independently freely rotatably mounted about said stanchion member to extend along substantially the entire extent of the longitudinal axis thereof, said stanchion member being articulable intermediate each adjacent pair of said collars.

13. The bollard of claim 10 wherein said stanchion member comprises a generally helically-coiled, tension spring member, said spring member extending between the proximal and distal ends of said stanchion along substantially the entire extent of the longitudinal axis thereof.

14. The bollard of claim 13 comprising at least a first and a second said collar independently freely rotatably mounted about said spring along the longitudinal axis thereof, said spring being articulable intermediate said first and said second collar.

15. The bollard of claim 13 comprising a plurality of said collars independently freely rotatably mounted about said spring member to extend along substantially the entire extent of the longitudinal axis thereof, said spring member being articulable intermediate each adjacent pair of said collars.

16. The bollard of claim 10 further comprising a luminary assembly mounted atop the upper distal end of said elongate member for illuminating at least a portion of said bollard.

17. The bollard of claim 16 wherein said luminary assembly comprises:

a housing connected to the upper distal end of said stanchion member, said housing formed has having a generally cylindrical sidewall portion extending upwardly from the distal end of said stanchion member to a terminal domed portion;

a lens integrally formed as a light-transmitting band within the sidewall portion of said housing; and a lamp disposed within said housing, said lamp being electrically energizable to illuminate said lens.

18. The bollard of claim 16 wherein said luminary assembly comprises:

a housing connected to the upper distal end of said stanchion member, said housing formed has having a generally cylindrical sidewall portion extending upwardly from the distal end of said stanchion member to a terminal domed portion;

a reflector integrally formed as a band within the sidewall portion of said housing, said reflector reflecting incident light for its illumination.

* * * * *